US006229255B1

(12) United States Patent
Kim et al.

(10) Patent No.: US 6,229,255 B1
(45) Date of Patent: May 8, 2001

(54) SHADOW MASK IN COLOR CRT HAVING SPECIFIC MATERIALS

(75) Inventors: Sang Mun Kim; No Jin Park; Myung Hoon Oh, all of Kyungsangbuk-do (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/295,402

(22) Filed: Apr. 21, 1999

(30) Foreign Application Priority Data

Apr. 21, 1998 (KR) ..... 98/14110

(51) Int. Cl.[7] ..... H01J 29/80
(52) U.S. Cl. ..... 313/402; 313/405
(58) Field of Search ..... 313/402, 405

(56) References Cited

U.S. PATENT DOCUMENTS 4,528,246 7/1985 Higashinakagawa et al. .
4,771,213 9/1988 Higashinakagawa et al. .

FOREIGN PATENT DOCUMENTS 61-84356A 4/1986 (JP) .

*Primary Examiner*—Vip Patel
(74) *Attorney, Agent, or Firm*—Birch, Stewart, Kolasch & Birch, LLP

(57) ABSTRACT

A shadow mask in a color CRT, of an Fe—Ni series invar alloy of which alloy composition, crystal grain size, and concentration of {100} crystal planes are adjusted so as to have an excellent etchability and formability, for forming uniform electron beam pass-through holes with a less etching deviation and better roundness by etching; and method for fabricating the same, the shadow mask consisting essentially of 35~38% Ni, 0.1~1.0% Mn, 0.05~0.5% Cr, 0.05~0.01% B, below 0.02% C, 0.001~8.0% Co, 0.001~0.01% N, below 0.008% O, below 0.1% of at least one of Ti, Er, Mo, V, Nb, Be, P, and the balance of Fe by weight, and having a {100} cube orientation crystal plane concentration of 15~35% and an average grain size of 3~15 μm, and the method including the steps of hot rolling, and annealing a slab obtained from steel with Fe and Ni as main compositions, melt in a converter or an electric furnace, and cast into ingot and rolled, or continuous cast, cold rolling for the first time and annealing for the first time, cold rolling for the second time and annealing for the second time, temper rolling and annealing, to obtain a thin plate having a 15~35% concentration of a {100} crystal planes, with a 3~15 μm average grain size, applying a coat of photoresist, exposing, developing, etching, and forming to take a shape, and coating with a black iron oxide.

12 Claims, 2 Drawing Sheets

SHADOW MASK IN COLOR CRT HAVING SPECIFIC MATERIALS

BACKGROUND OF THE INVENTION

1. Field of the Invention

The present invention relates to a shadow mask in a color cathode ray tube (CRT), of an Fe—Ni series invar alloy having uniform electron beam pass-through holes, and the method of preparation of the same which include adjusting the alloy composition, crystal grain size, and concentration of {100} crystal planes so as to have excellent etchability and formability for forming the uniform electron beam pass-through holes with less etching deviation and better roundness.

2. Discussion of the Related Art

Referring to FIG. 1, a color CRT is provided with a panel 1 coated with fluorescent films 3 on an inside surface thereof, a funnel 2 coated with conductive graphite on an inside surface thereof and fusion welded to the panel 1 with a glass at a temperature of approx. 450° C. in a furnace, an electron gun 6 in a neck portion 4 of the funnel 2 for emitting electron beams 5, the shadow mask 7, being a color selection electrode, supported by frames 8 on an inner side of the panel 1, and deflection yokes 9 for deflecting the electron beams in left and right directions. The reference numeral 10 denotes an inner shield.

When a video signal is provided to the aforementioned color cathode ray tube, thermal electrons 5 are emitted from cathodes in the electron gun 6 and travel toward the panel 1, while being accelerated and focused by different electrodes in the electron gun 6. In the travel, the electron beams 5 are deflected causing changes in their travel path by a magnetic field generated by the deflection yokes 9 on the neck portion 4 of the funnel 2, thus scanning an entire surface of the panel 1. The deflected electron beams 5 are used to represent a color as they pass through a slot in the shadow mask 7 supported from an inside frame of the panel 1 since those electron beams collide with different fluorescent films 3 on the inside surface of the panel 1, to generate light, thereby reproducing the video signal.

A rimmed iron in JIS G3141 series or an aluminum killed steel(AK steel), each being a pure iron, are conventionally used as a material for fabricating shadow masks 7 in a color cathode ray tube. However, due to the large thermal expansion coefficients of these materials (pure steel: $11.5\times10^{-6}deg^{-1}$) and the screen currently developed for a high definition TV, thermal expansion of the shadow mask 7 resulting from heat caused by collision of the electrons emitted from the electron gun and the shadow mask causes doming, which is a color dispersion experienced when the electron beams collide with a fluorescent surface corresponding to a color other than a designated color due to the thermal expansion. In order to prevent doming, an invar alloy of Fe—Ni series having a smaller thermal expansion coefficient ($1.5\times10^{-6}deg^{-1}$) is employed.

The shadow mask 7 is fabricated as follows.

A slab, formed from casting of a molten steel having an invar composition in a converter or an electric furnace, is subjected to hot rolling, annealing, acid cleaning and cold rolling, thereby forming a thin plate with a thickness of 0.1~0.5 mm. During cold rolling, the number of times the rolling is conducted depends on the reduction ratio. Then, an intermediate annealing process is conducted at a temperature over 800° C., where the slab is temper rolled to control the thickness and surface roughness and annealed. The surface is cleaned and dried, a coat of photoresist is applied, exposed and developed, etched by a ferrous chloride solution, removed, cut, etc., to obtain a circular plate with holes. The circular plate is then cleaned, dried, annealed at a temperature over 800° C., hot pressed, black iron oxide coated, weld assembled and packed, to obtain a shadow mask as shown in FIG. 1.

As the shadow mask of invar alloy has a small thermal expansion coefficient, facilitating to form an exact pass of the electron beams irrespective of the temperature, the invar alloy is widely used as a material of shadow masks suitable for display of high definition TV broadcasting systems and computers which require a high definition still image. In order to obtain a high definition shadow mask of such an invar alloy, small pitched uniform holes should be formed in the shadow mask material by etching. However, despite its low thermal expansion coefficient, the invar alloy is a material which has typically not etched well with difficulty in obtaining uniform holes. Therefore, improving the etchability of the invar alloy has been an important subject to be solved. For example, Japanese laid open patent No. S61-82453 restricts the carbon content to be below 0.01% and Japanese laid open patent No. S61-84356 restricts the non-metallic components, for improvement of the etchability. And, Japanese patent publication No. S59-32859, Japanese patent publication No. S61-19737, Korean patent publication No. 88-102 and 87-147, and U.S. Pat. No. 4, 528,246 claim that a shadow mask material of invar alloy with a concentration over 35% of {100} crystal planes obtained by controlling the cold rolling and annealing in the shadow mask raw material forming process permits good etching to facilitate the formation of uniform electron beam pass-through holes, resulting in a reduction in the doming, and thus improved color reproduction. However, conventional invar alloy material has S, B, N impurities even when the carbon content is below 0.01%. Since the impurities are segregated from crystal grains or exist as interstitial atoms in the crystal when annealed, the impurities affect the etchability. Thus, the impurities should be controlled. In view of the {100} crystal plane having the fastest etch rate, the etching can be carried out efficiently when the {100} planes are agglomerated in a rolled surface. However, if the {100} crystal plane concentration is too high, the fast etching results in the formation of non-round holes, particularly, if the concentration is over 95%. The etching proceeds along the crystal plane, resulting in the formation of holes which are not round and non-uniform. Therefore, the concentration of the {100} crystal planes over 35% as disclosed by Japanese patent publication No. S61-19737 claims is not satisfactory, since the etchability is influenced by other factors, such as crystal grain sizes, composition of elements, formation process conditions, orientations of the crystal grains, and the like or combinations thereof.

SUMMARY OF THE INVENTION

Accordingly, the present invention is directed to a shadow mask in a color cathode ray tube that substantially obviates one or more of the problems due to limitations and disadvantages of the related art.

An object of the present invention is to provide a shadow mask in a color cathode ray tube, which has uniform electron beam pass through holes having excellent roundness formed with a small etching deviation. The shadow mask is formed of a particular composition, under controlled process conditions, to effect the texture, and crystal grain for improved of etchability and formability.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. However, it should be understood that the detailed description and preferred embodiments of the invention, are given by illustration only, since various changes and modifications within the spirit and scope of the invention will become apparent to those skilled in the art from this detailed description.

To achieve these and other advantages and in accordance with the purpose of the present invention, as embodied and broadly described, the shadow mask in a color cathode ray tube is formed of a shadow mask raw material having good etchability and good formability. Therein, the raw material includes Fe and Ni as the main components, the {100} orientated crystal plane concentration is 15~35% and the average grain size is 3~15 $\mu$m.

The shadow mask raw material comprises 35~38% Ni, 0.1~1.0% Mn, 0.05~0.5% Cr, 0.05~0.01% B, below 0.02% C, 0.001~8.0% Co, 0.001~0.01% N, below 0.008% O, below 0.1% of at least one of Ti, Er, Mo, V, Nb, Be, P, and the balance being Fe, each percentage is by weight and is based on the total mass of the material.

In another aspect of the present invention, there is provided a method for fabricating a shadow mask in a color cathode ray tube, which includes the steps of hot rolling, annealing a slab obtained from steel with Fe and Ni as the main components, melting in a converter or an electric furnace, and either casting into an ingot and rolling, or continuous casting, then cold rolling for the first time and annealing for the first time, cold rolling for the second time and annealing for the second time, temper rolling and annealing, to obtain a thin plate having a 15~35% concentration of a {100} crystal planes, with a 3~15 $\mu$m average grain size. A coating of photoresist material is then applied, exposed, developed, etched, shaped, and coated with black iron oxide.

It is to be understood that both the foregoing general description and the following detailed description are exemplary and explanatory and are intended to provide further explanation of the invention as claimed and not to be considered as limitative of said claimed invention.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Most metals are composed of small polycrystalline grains which seldom exhibit random orientation, but exhibit a preferred orientation(or texture) through a plastic deformation by a hot or cold processing or a manufacturing process, such as heat treatment, which causes a crystalline structural change, which affects the mechanical, magnetic and chemical properties of the metal. Particularly, in the case of a re-crystallized cubic lattice, such as a face centered cubic lattice of an invar alloy of a shadow mask material, good etching is dependent on the orientation of the crystal. Since etching is more readily performed in the {100} crystal plane, a three dimensional analysis of the crystal orientation in the material is required for a correct understanding of its etchability.

Figure 1:
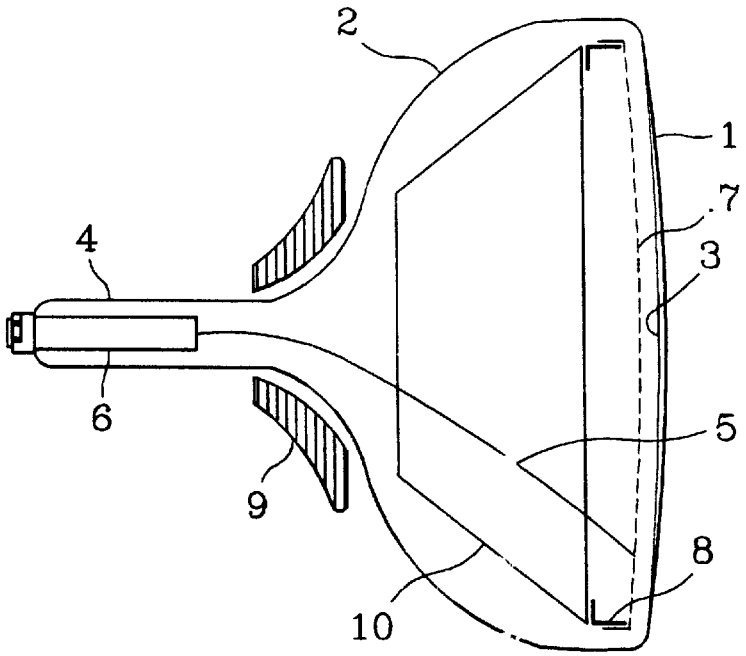
FIG. 1 illustrates a structure of a color cathode ray tube.
Figure 2:
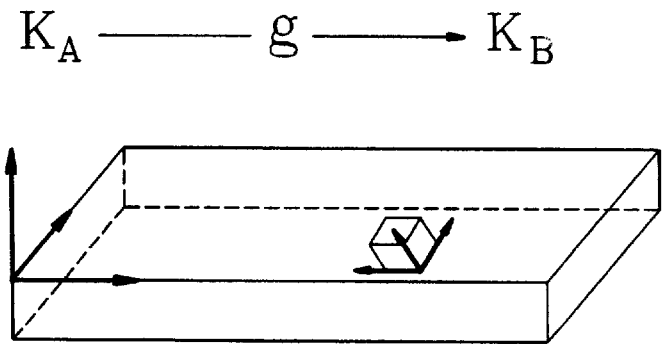
FIG. 2 illustrates relations between a crystal grain orientation and test piece coordinates; and, FIG. 3 illustrates locations of orientations in an inverse pole figure.

First of all, for a better understanding of the texture of the steel, i.e., the distribution and orientations of crystal grains, it is necessary to set up a relation between the crystal orientation in each test piece and a test piece coordinate system as shown in FIG. 2. If it is assumed that the direction of rotation required for transformation of a test piece coordinate system $K_A$ to a crystal coordinate system $K_B$ is "g", the texture may be expressed as an orientation distribution function f(g), representing a volumetric fraction of crystals in a particular direction "g " in the test piece and a multiple of random orientation without texture. The direction "g" may be represented with Euler angles $\{\Phi_1, \Psi, \Phi_2\}$, or with Miller indices (hkl)[uvw]. A plate may be represented with Miller indices by having (hkl) represent a plane $$f(g)_{(hkl)[uvw]} = \frac{dV(g)_{(hkl)[uvw]}/V}{dg_{(hkl)[uvw]}} \tag{1}$$

parallel to the rolling direction and [uvw] represent the rolling direction as in Equation (1).

Where, $g=\{\Phi_1, \Psi, \Phi_2\}$, and V is a volume of the test piece.

Figure 3:
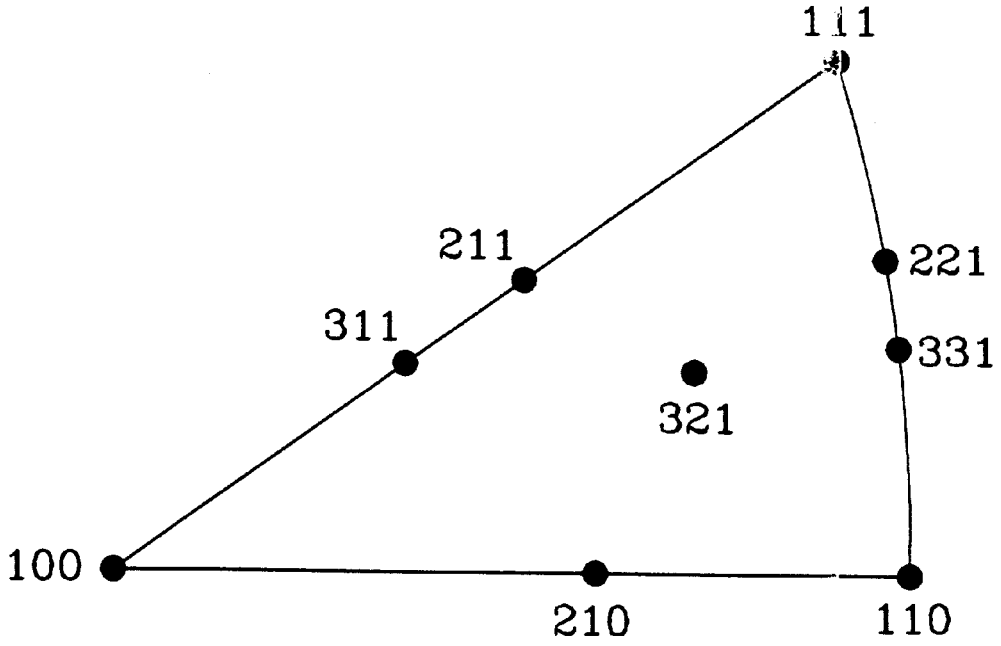

In the shadow mask of an invar alloy having a face centered cubic lattice, diffraction intensities of crystal grains are measured by X-ray diffraction using a goniometer while rotating four pole figures of {111}, {200}, {220}, {311} in all possible directions. The diffraction intensity is proportional to a volume of crystal grains on the particular plane {hkl} in a test piece consistent with a diffraction plane. Thus, the four pole figures of {111}, {200}, {220}, {311} are measured, the full orientation distribution function is calculated using a harmonic method and adjusted to positive space, and the inverse pole figure is calculated for each crystal plane with respect to a direction perpendicular to plate surface. Also, the diffraction intensities $R_{\{111\}}$, $R_{\{200\}}$, $R_{\{220\}}$, $R_{\{311\}}$ of each of the crystal planes are calculated by Equation (2),shown below, and exist at locations on an inverse pole figure as shown in FIG. 3, (for reference, {100} and {200} and {110} and {220} are equivalent crystal planes).

$$R_{(hkl)} = \frac{1}{2\pi}\int f(g)d\psi \tag{2}$$

Where $\psi$ is the projected area of a crystal plane {hkl} on a particular test piece direction in orientated space.

In the present invention, invar alloy is prepared so as to have a concentration of the diffraction intensity $R_{\{100\}}$ of {100} crystal planes of 15%~35% with an average grain size of 3~15 $\mu$m based on the $R_{\{111\}}$, $R_{\{200\}}$, $R_{\{220\}}$, and $R_{\{311\}}$ as calculated by the above equation. These factors act to improve the etchability and the geomagnetism cut-off capability, resulting in a shadow mask with uniform holes having excellent roundness due to less etch deviation.

$$\text{Concentration of } \{100\}(\%) = \frac{R_{\{100\}}}{R_{\{100\}} + R_{\{111\}} + R_{\{311\}} + R_{\{110\}}} \cdot 100 \quad (3)$$

When the concentration of the {100} crystal plane is less than 15%, the etchability drops, and when it is greater than 35%, the etchability may be improved, but the etchability may drop when the texture has the {311}, {110}, and {112} crystal planes at a higher concentration than the {100} crystal planes. Furthermore, when the grain size is less than 3 $\mu$m, though the etchability may be improved, the formability can decrease due to an increased yield strength, and when the grain size is greater than 15 $\mu$m, the etch rate may be dropped due to greater grain size and also results in non-uniform shape of the holes.

With regard to alloy compositions for the shadow mask, Ni and Co are used for adjusting the thermal expansion property, N, C, Ti, Zr, B, Mo, V, Nb, Be, P are used for suppressing grain growth, and B, Cr, Mn are used to improve the hot formability.

Function and content of the aforementioned elements in the invar alloy will be explained.

Ni: Nickel is a major composition in a shadow mask of Fe—Ni invar alloy, with a 35 wt %~38 wt % content to a total weight for having a low thermal expansion coefficient of below $2\times10^{-6}$/° C., and preferably 35.5~36.5 wt %. If the content is either below 35 wt % or above 38%, the thermal expansion is increased sharply, thereby increasing a doming in the color cathode ray tube.

Co: Cobalt acts as an agent for controlling thermal expansion and improving etchability in the invar alloy of the shadow mask, with a content of 0.001~1.0% in an Fe-36% Ni series. If the content is below 0.001%, the cobalt can not aid in the decrease of the thermal expansion, and if greater than 1.0 wt %, the thermal expansion is increased.

Mn: Manganese improves the thermal formability in an invar alloy thin plate formation, with a content of 0.1~1 wt %. If the content is over the upper limit, the hardness of the invar alloy rises, and if the content is below the lower limit, there is no improvement in the thermal formability.

Cr: Chromium in a range of 0.05~0.5 wt % improves the adhesion of the black iron oxide coating to the invar alloy in the black iron oxide coating process after subjecting the invar alloy thin plate to invar mask etching, annealing, and forming. If the content is greater than the upper limit, the hardness of the invar alloy rises, causing possible defects at edges of the invar mask in formation of the invar alloy, and the thermal expansion coefficient of the invar alloy rises. If the content is below the lower limit, the adhesion of the black iron oxide coating to the invar alloy drops.

B: Boron improves the thermal formability and aids in the formation of finer grains in the invar alloy thin plate, with a content of 0.005~0.01 wt %. If the content is higher than the upper limit, the hardness of the invar alloy rises, and the segregation of nitrogen as boron nitride occurs at the grain boundaries as the Fe—Ni alloy recrystallizes during annealing after rolling. The BN decreases the etchability and provides for a poor surface condition. If the content is below the lower limit, grain growth is caused, and there is no formability improvement.

N: Nitrogen, an element entrained into the invar alloy in formation of the invar alloy thin plate, acts as an agent controlling the grain size. The nitrogen content in the invar alloy is 0.001~0.01 wt %. If the nitrogen is added over the upper limit, the grains are grown too small, with a rise in yield strength, that causes poor formability. If the nitrogen content added to the invar alloy is below 0.001 wt %, the grain growth can not be controlled to the desired grain size, with a failure in obtaining the desired etchability.

C: Carbon is added as a reducing agent and the grain growth inhibitor in the formation of invar alloy thin plate, with a content below 0.02%. If the content is greater than the upper limit, a carbide is produced, dropping the etchability and raising the yield strength, that causes poor formability, and drops the magnetism, which results in poor geomagnetic properties.

Ti, Mo, V, Zr, Nb, Be, P: These elements are added as unavoidable impurities, and act as grain growth inhibitors, which improves the adhesion of the black iron oxide coating. However, if the total impurity content exceeds 0.1 wt %, the hardness rises, causing a failure in obtaining the level of yield strength required for forming, even after annealing.

Si: Silicon acts as a reducing agent in the formation of the invar alloy thin plate, with a content below 0.1 wt %. If the content is higher than this, the yield strength rises resulting in poor formability.

O: Oxygen is an unavoidable component entrained in formation of the invar alloy thin plate. If the oxygen content is high, non-metallic oxides are increased, dropping the etchability resulting in a poor etch surface. Accordingly, the oxygen content is suppressed to be below 0.008wt %.

The invar alloy shadow mask of the present invention is fabricated according to the following steps.

A slab obtained from steel with the aforementioned composition, is melted in a converter or an electric furnace, and is either cast into an ingot and rolled, or continuous cast, and then is hot rolled at a temperature higher than 1000° C. into a steel plate having a thickness of 2~5 mm and annealed at a temperature higher than 900° C. The annealed steel palate is acid cleaned, and cold rolled for the first time into a thin plate with a thickness of 0.5~1.0 mm. In the first cold rolling, the cold rolling may be conducted plural times, with a reduction ratio for one time of cold rolling set to be in a range of 45~60%. In continuation to the first cold rolling, the thin plate is annealed for the first time under ambient hydrogen at a temperature ranging 1000~1200° C. and subjected again to cold rolling for the second time to obtain a thin plate of 0.1~0.5 mm. In conducting the second cold rolling, the cold rolling may be conducted plural times, with a reduction ratio compared to a thickness after the first time cold rolling set to be in a range of 50~80%. The number of times the plate is subjected to cold rollings and the reduction ratios may be adjusted appropriately, and is not limited in the present invention. After the second time cold rolling, the plate is annealed for the second time, temper rolled with a reduction ratio below 5% to adjust the thickness and surface quality, and annealed at a temperature of 600~1000° C. Thus, by passing though the aforementioned steps, the invar alloy thin plate can have a 15~35% concentration of the {100} crystal planes, with a 3~15 $\mu$m average grain size. The thin plate from the aforementioned process is cleaned and dried, a coat of photoresist applied, exposed and developed, etched by a ferrous chloride solution, cleaned and dried, to fabricate a shadow mask with holes for passing of the electron beams, and formed to take shape, and black iron oxide coated, to obtain a completed shadow mask. Accordingly, in comparison to the conventional process in which a separate annealing step is conducted on the steel plate during shaping in the color cathode ray tube, in the process of forming the shadow mask of the present invention, no separate annealing during the shaping step is required. If necessary, an annealing step may be conducted at a temperature ranging 800~1000° C. for better formability after etching and before the shaping step in the fabrication of the color cathode ray tube.

The present invention will be explained, taking an embodiment as an example.

Raw materials were mixed in compositions, by weight %, of Fe 63%, Ni 36%, Mn 0.2%, Cr 0.1%, C 0.01%, Mo 0.003%, Si 0.05%, B 0.005%, N 0.005%, Co 0.8%, melted together under a vacuum, formed into an ingot, subjected to continuous hot wire drawing into 8 mm diameter wire and lengthwise forging, to obtain a plate 2.0 mm thick and 100 mm wide. The plate was then subjected to hot rolling at 1100° C., annealed at 1030° C., first time cold rolled plural times in a continuous fashion with a reduction ratio of 57% to form a 0.4 mm thick plate, annealed at 1000° C. for more than 1 hour in ambient hydrogen, and cold rolled for the second time with a 70% reduction ratio. Then, the thin plate was directly subjected to annealing for the second time at 1000° C., temper rolled with a reduction ratio of 5%, and annealed at 800° C. for 30 min., to form a shadow mask plate material with a 15~35% concentration of the {100} crystal planes and a thickness of 0.114 mm. The plate was then etched with a 38% ferrous chloride solution, to form electron beam pass-through holes and formed into a particular shape. The etched thin plate may be annealed at 900° C. for 30 min. additionally before being shaped.

Base materials of the invar shadow mask were prepared under various process conditions. Etchabilities were determined by evaluating a {100} crystal plane concentration and the grain size before etching, and the shape freeze was evaluated after annealing at 900° C. for 30 min. and the formation, of which results are shown in TABLE 1 with comparative examples. The invar shadow mask materials taken as the comparative examples are those formed according to Japanese Laid Open Patent No. S61-19737 with a {100} crystal plane concentration over 35%.

TABLE 1

| | anneal before forming | {100} plane concentration (%) | grain size (μm) | etching factor | roundness | shape freeze |
|---|---|---|---|---|---|---|
| Embodiment 1 | No | 34.8 | 8 | 1.95 | 1.02 | 0 |
| Embodiment 2 | No | 28.6 | 7 | 2.03 | 1.01 | 0 |
| Embodiment 3 | No | 27.5 | 8 | 2.05 | 0.997 | 0 |
| Embodiment 4 | No | 21.7 | 10 | 1.89 | 0.995 | 0 |
| Embodiment 5 | No | 19.6 | 12 | 1.92 | 0.99 | 0 |
| Embodiment 6 | No | 13.5 | 18 | 1.84 | 0.98 | 1 |
| Embodiment 7 | No | 14 | 27 | 1.45 | 0.96 | 2 |
| Embodiment 8 | Yes | 16.2 | 14 | 1.90 | 0.99 | 0 |
| Comparative Example 1 | Yes | 68 | 11 | 1.8 | 0.95 | 2 |
| Comparative Example 2 | Yes | 89 | 10 | 1.89 | 0.997 | 0 |
| Comparative Example 3 | No | 37 | 22 | 1.62 | 0.94 | 8 |

It can be realized from TABLE 1 that an invar shadow mask having good etchability and formability can be fabricated when the {100} crystal plane concentration is 15~35% with a 3~15 μm crystal grain size even if no annealing is conducted after the etching. On the other hand, it can not be said that good etchability can be obtained without fail even if the concentration of the {100} crystal plane is over 35%. It was found that, if the {100} crystal plane concentration is below 15%, the crystal grain size is increased on annealing after the temper rolling, with a drop in etchability and shape freeze.

The aforementioned embodiments and comparative examples were evaluated as follows.

{100} crystal plane concentration: Diffraction intensities of crystal grains of invar shadow mask were measured by X-ray diffraction using a goniometer while rotating four pole figures of {111}, {200}, {220}, {311} in all possible directions, a full orientation distribution function (ODF) was calculated using a harmonic method and a positivity, an inverse pole figure was calculated for each crystal plane with respect to a direction perpendicular to plate surface, and diffraction intensities $R_{\{111\}}$, $R_{\{200\}}$, $R_{\{220\}}$, $R_{\{311\}}$ of each of the crystal planes were calculated by the equation (2), to obtain the {100} crystal plane concentration.

Crystal grain: The crystal grain was evaluated by means of an optical microscope after polishing, and etching a surface of a plate. The etchant used was 5 ml $HNO_3$+100 ml HCl +200 ml methanol+100 ml distilled water+2 g $CuCl_2$+7 g $FeCl_3$.

Etching factor: Is a ratio of the measure of the depth of the hole to the distance between a point in the middle of the hole which lies in the plane of the surface of the plate to the surface edge of the hole and is measured by microscope. The etching factor was obtained from a hole etched to 150 μm formed by spray of a ferrous chloride solution through a photoresist pattern with a hole of 100 μm diameter at etching conditions of 42 Baume' of solution concentration, 50° C., and 2.5 $Kgf/cm^2$.

Roundness: A ratio of the farthest distance and the shortest distance between two parallel lines drawn tangentially to the hole in the plane of the surface of the plate. A roundness ranging 1.10~0.99 is evaluated good.

Shape freeze: A shape freeze is a measure of the extent of distortion in the shape, i.e., a ratio of defective shapes at the periphery of the mask after pressing, for 100 samples.

It will be apparent to those skilled in the art that various modifications and variations can be made in the shadow mask in a color cathode ray tube and the method for fabricating the same of the present invention without departing from the spirit or scope of the invention. Thus, it is intended that the present invention cover the modifications and variations of this invention and are not necessarily limited by the scope of the appended claims and their equivalents.

What is claimed is:

1. A shadow mask in a color cathode ray tube formed of a shadow mask raw material with a good etchability and a good formability, the raw material comprising Fe and Ni as main components and has a {100} cube orientation crystal plane concentration of 15~35% and an average grain size of 3~15 μm.

2. The shadow mask as claimed in claim 1, wherein the shadow mask raw material comprises 35~38% Ni, 0.1~1.0% Mn, 0.05~0.5% Cr, 0.05~0.01% B, below 0.02% C, 0.001~8.0% Co, 0.001~0.01% N, below 0.008% O, below 0.1% of at least one of Ti, Er, Mo, V, Nb, Be, P, and the balance is Fe, wherein each percent value is w/w and is based on the weight of the raw material.

3. A method for fabricating a shadow mask in a color cathode ray tube, comprising the steps of:

hot rolling, and annealing a slab obtained from steel with Fe and Ni as main components; melting in a converter or an electric furnace; casting into an ingot and rolling, or continuous casting;

cold rolling for the first time and annealing for the first time;

cold rolling for the second time and annealing for the second time;

temper rolling and annealing; thereby obtaining a thin plate having a 15~35% concentration of a {100} crystal planes, with a 3~15 μm average grain size; applying a coat of photoresist, exposing, developing and etching; and, forming into a shape, and coating with black iron oxide.

4. The method as claimed in claim 3, wherein the shadow mask comprises 35~38% Ni, 0.1~1.0% Mn, 0.05~0.5% Cr, 0.05~0.01% B, below 0.02% C, 0.001~8.0% Co, 0.001~0.01% N, below 0.008% O, below 0.1% of at least one of Ti, Er, Mo, V, Nb, Be, P, and the balance is Fe wherein each percent value is w/w and is based on the weight of the steel.

5. The method as claimed in claim 3, wherein the hot rolling is conducted at a temperature over 1000° C.

6. The method as claimed in claim 3, wherein the first cold rolling step is conducted plural times with a reduction ratio of 45~60%.

7. The method as claimed in claim 3, wherein the second cold rolling step is conducted with a reduction ratio of 50~80% based on the width of the plate after the first cold rolling and after the second cold rolling.

8. The method as claimed in claim 3, wherein the second annealing step is conducted at 1000~1100° C.

9. The method as claimed in claim 3, wherein the temper rolling step is conducted after the second annealing step with a reduction ratio below 5%.

10. The method as claimed in claim 3, wherein the annealing step after the temper rolling step is conducted at 600~1000° C.

11. The method as claimed in claim 3, wherein an annealing step is conducted after etching and before the forming step.

12. The method as claimed in claim 8, wherein the temper rolling step is conducted after the second annealing step with a reduction ratio below 5%.

* * * * *